US007562790B2

(12) United States Patent
Wheeler et al.

(10) Patent No.: US 7,562,790 B2
(45) Date of Patent: Jul. 21, 2009

(54) MULTIFUNCTIONAL MEDICINAL DISPENSARY DEVICE

(75) Inventors: John C. Wheeler, Rutland, VT (US); George T. Sotirakis, Rutland, VT (US)

(73) Assignee: Medical Safety Equipment, Inc., Rutland, VT (US)

( * ) Notice: Subject to any disclaimer, the term of this patent is extended or adjusted under 35 U.S.C. 154(b) by 117 days.

(21) Appl. No.: 11/812,683

(22) Filed: Jun. 21, 2007

(65) Prior Publication Data

US 2008/0314919 A1 Dec. 25, 2008

(51) Int. Cl.
*B65D 83/04* (2006.01)

(52) U.S. Cl. ..... 221/31; 221/30; 221/27; 221/256; 206/538; 206/539; 241/101.2

(58) Field of Classification Search ..... 221/25–30, 221/233–235, 241, 255–257; D24/133; 206/538–539; 241/101.2

See application file for complete search history.

(56) References Cited

U.S. PATENT DOCUMENTS

| | | | | |
|---|---|---|---|---|
| 2,631,786 | A | 3/1953 | Morgan et al. | |
| 3,915,393 | A | 10/1975 | Elkins | |
| 4,121,775 | A | 10/1978 | Roseberg et al. | |
| 4,179,806 | A | 12/1979 | Lieptz | |
| 4,457,427 | A | 7/1984 | Cafiero | |
| 4,694,996 | A | 9/1987 | Siegel | |
| 5,148,995 | A | 9/1992 | Hurst | |
| 5,431,283 | A | 7/1995 | Weinstein et al. | |
| 5,791,513 | A * | 8/1998 | Intini | 221/30 |
| 5,823,451 | A * | 10/1998 | Sharpe | 241/169.2 |
| 5,915,637 | A | 6/1999 | Parsons | |
| 6,059,209 | A * | 5/2000 | Barson | 241/168 |
| 6,523,766 | B1 | 2/2003 | Watt | |
| 6,527,155 | B2 * | 3/2003 | Buckley et al. | 225/1 |
| 6,557,740 | B1 * | 5/2003 | Dent | 225/104 |
| 6,637,683 | B1 | 10/2003 | (Lomax) Wilbur | |
| 6,966,509 | B2 | 11/2005 | Janzen | |
| 7,051,898 | B1 * | 5/2006 | Connell | 221/30 |
| D533,661 | S * | 12/2006 | Yip | D24/133 |
| 7,175,044 | B2 | 2/2007 | Benktzon et al. | |
| 7,264,137 | B2 * | 9/2007 | Drought et al. | 221/25 |
| 7,413,137 | B2 * | 8/2008 | Donovan | 241/168 |
| 7,431,160 | B2 * | 10/2008 | Drought et al. | 206/528 |
| 2006/0138158 | A1 * | 6/2006 | Drought et al. | 221/25 |

FOREIGN PATENT DOCUMENTS

| | | |
|---|---|---|
| DE | 28 07 174 | 8/1978 |

* cited by examiner

*Primary Examiner*—Gene Crawford
*Assistant Examiner*—Michael K Collins
(74) *Attorney, Agent, or Firm*—John J. Welch, Jr., Esq.

(57) ABSTRACT

A multifunctional medicinal dispensary device made up of an armstand, an arm with an attached punchknob pivotably connected thereto and equipped with a handle as well as a punchplate with a hole in it being attached to the topside of the armstand along with a splitter bar and splitterguard each connected to the arm and a pillcrusher component also pivotably affixed a pivotstand affixed to the arm and laterally positioned pill compartments within the armstand all for the purpose of extracting pills from pill packs, splitting and/or crushing them or for extracting liquid medicine from within capsular pill jackets, all very hygienically, economically and efficiently with only minimal effort, without waste.

6 Claims, 9 Drawing Sheets

MULTIFUNCTIONAL MEDICINAL DISPENSARY DEVICE

CROSS REFERENCES TO PRIOR OR PARENT APPLICATIONS

Figure 1:
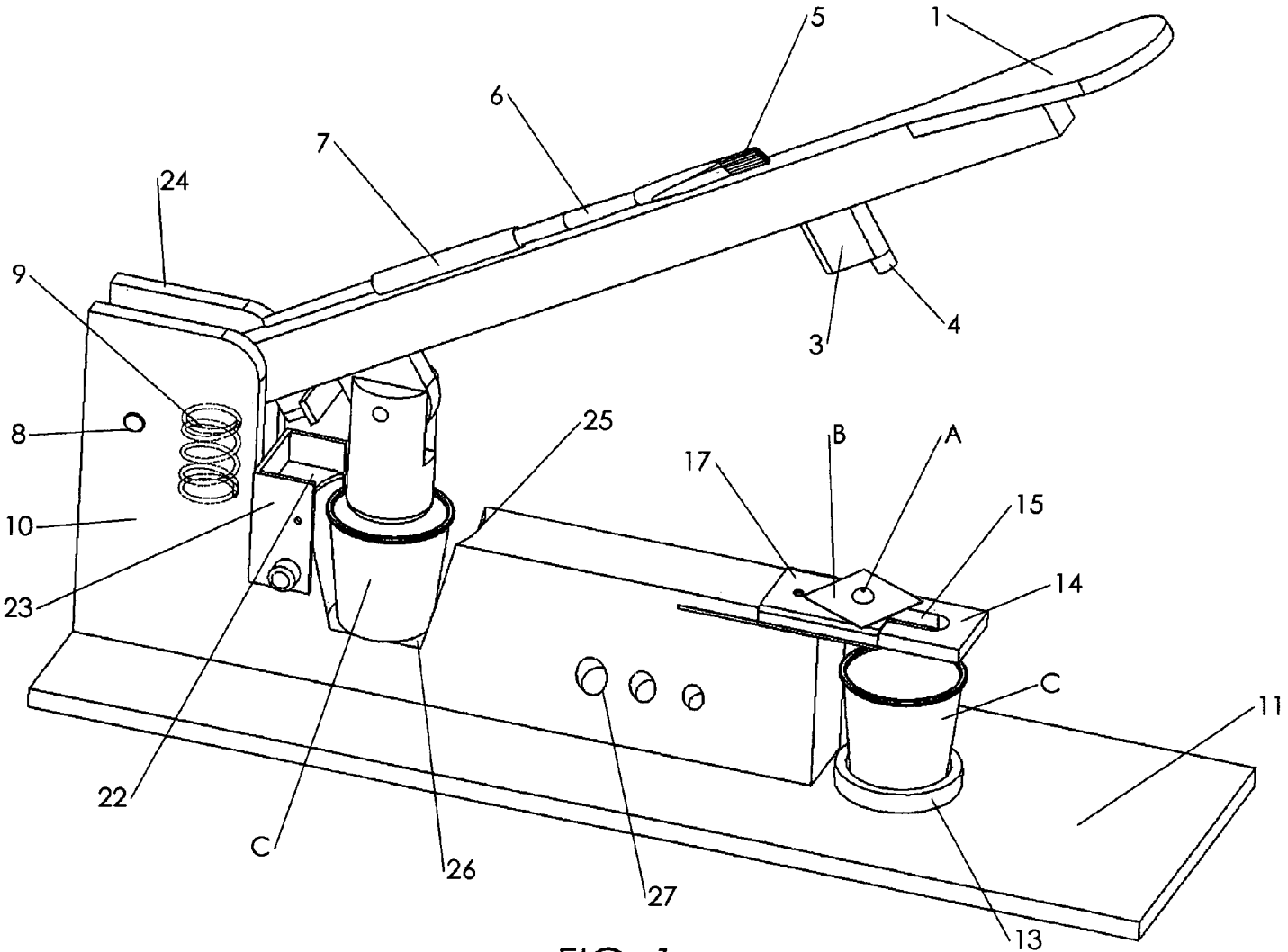

The invention is not the subject of any prior or parent applications.

FEDERALLY SPONSORED RESEARCH AND DEVELOPMENT

The invention is not the subject of any federally sponsored research or development.

BACKGROUND OF THE INVENTION

1. Field of the Invention

The instant invention relates to those sorts of devices utilized to dispense medicines to persons in need of the same.

2. Related Art

The enclosed Art Informational Statement references art that related to but does not anticipate the invention.

SUMMARY OF THE INVENTION

1. A Brief Description of the Invention

The invention is made up of a handle anteriorly attached to an arm. Attached to the bottomside of the arm is a punchknob that has a punchknob tooth component affixed thereto at the bottom thereof. A brush holder affixed atop the arm holds a fixation component with attached brush. The arm is pivotable about an armstand and is bottomwise at near the posterior end thereof, amenable to contact with a top edge of a reset spring attached to the posterior top side of the armstand. The armstand is mounted to a rectangularly shaped basestand equipped on the bottomside thereof with an anti-skid pad. A recessed first pillcup well is found about the anterior topside of the basestand just below the locus of a punchplate extending anteriorly outward from the armstand and characterized by the presence of a punchplate aperture. The punchplate is mounted to the anterior topside of the armstand. Slideably mounted to the punchplate is a pillsize slider unit within which there are multiple pillsize apertures. Pivotably mounted to a pivotstand mounted to the bottomside of the arm posterior to the locus of the punchknob is a pill crusher unit. A splitterguard component is mounted to the bottomside of the arm posteriorly to the pivotstand. Mounted posteriorly and perpendicularly to the lie of the splitterguard component and also to the bottomside of the arm is a pillsplitter. Pivotably mounted to the armstand just anteriorly to the locus of the reset spring is a pill tray. A pillcup wellspace is cut into the armstand just anteriorly to the locus of affixation of the pill tray. Finally, a plurality of pill compartments are cut at a bias into one of the lateral sides of the armstand.

2. Objects of the Invention

Repeated dispensation of medication to a series of patients on a daily basis requires oftentimes, at the very least, that a nurse repeatedly use her index finger and thumb to hold and then press pills out of plastic covered pill compartments in pill packs. Such endeavors are tedious and over time and multiple repetitions, also painful work for any nurse involved in such pill extraction undertakings. Moreover, such extraction undertakings invariably require the nurse, quite often, to touch the extracted pill to place it in a pillcup for the patient. Also, oftentimes, during such extractions, the pills will pop out of the pill packs in which they are packaged and land on the tray holding pillcups for different patients or perhaps even fall into wrong cups. The feature of the invention that enables a nurse to, via resort to the punchknob component of the invention, punch pills out of a pill-pack and into respectively individual cups held in the well below it via the pillsize slider with apertures component of the invention, operates to wholly obviate the invariable tedium involved in repetitive multiple thumb and finger directed extractions not to mention the fact of unavoidable touching of the extracted pills. That such a feature accordingly serves to monumentally promote hygiene within a hospital or nursing home setting cannot be denied. Moreover, the splitter component of the invention promotes economy with respect to the preservation of medications to be provided to patients. Currently, the process of a splitting of medications so as to provide appropriate dosages is a hit or miss proposition, and; virtually always, any unused portion of the split medication must be discarded as often with conventional splitting, such unused portion will be seen to fly here and there under the force of such splitting. Such is however clearly not the case with resort to utilization of the invention with its splitterguard feature meant for such purposes. The brush component of the invention can then be used to simply sweep any such to-be unused split portion of such medications into a pill cup for future use on a next dose basis for any given patient.

Also, the crushing feature of the invention serves to ensure that medication so crushed will have already been within the pillcup for which it would ultimately be destined instead of having to somehow be there transferred from a pestle where such crushing would have occurred under the influence of a mortar device. Also, the pivotability of the pillcrusher assures maximally efficient contact with a pill to be crushed within a cup. Furthermore, a nurse's ability to extract, split and crush all within the framework of one setting with but one device is, in and of itself, a marked advantage over any confluence of current protocols involving the accomplishment of any one or more of such undertakings with multiple devices. Nurses with hands predisposed to arthritis and hospitals in need of promoting economy of and hygiene in respect of dispensation are obviously benefited one and all with resort to utilization of the invention. Finally, the compartments cut at a bias into the lateral walling of the armstand component of the invention serve to enable one to therein readily place capsular pills meant to have liquid therein hypodermically extracted so as to, without any need for ever handling such capsules, readily accomplish the same.

Respectfully submitted, in light of the foregoing recitations, the invention is not merely new, useful and unique; but rather instead is virtually revolutionary in the art of dispensing medications to persons in need of the same.

A DESCRIPTION OF THE DRAWINGS

Figure 2:
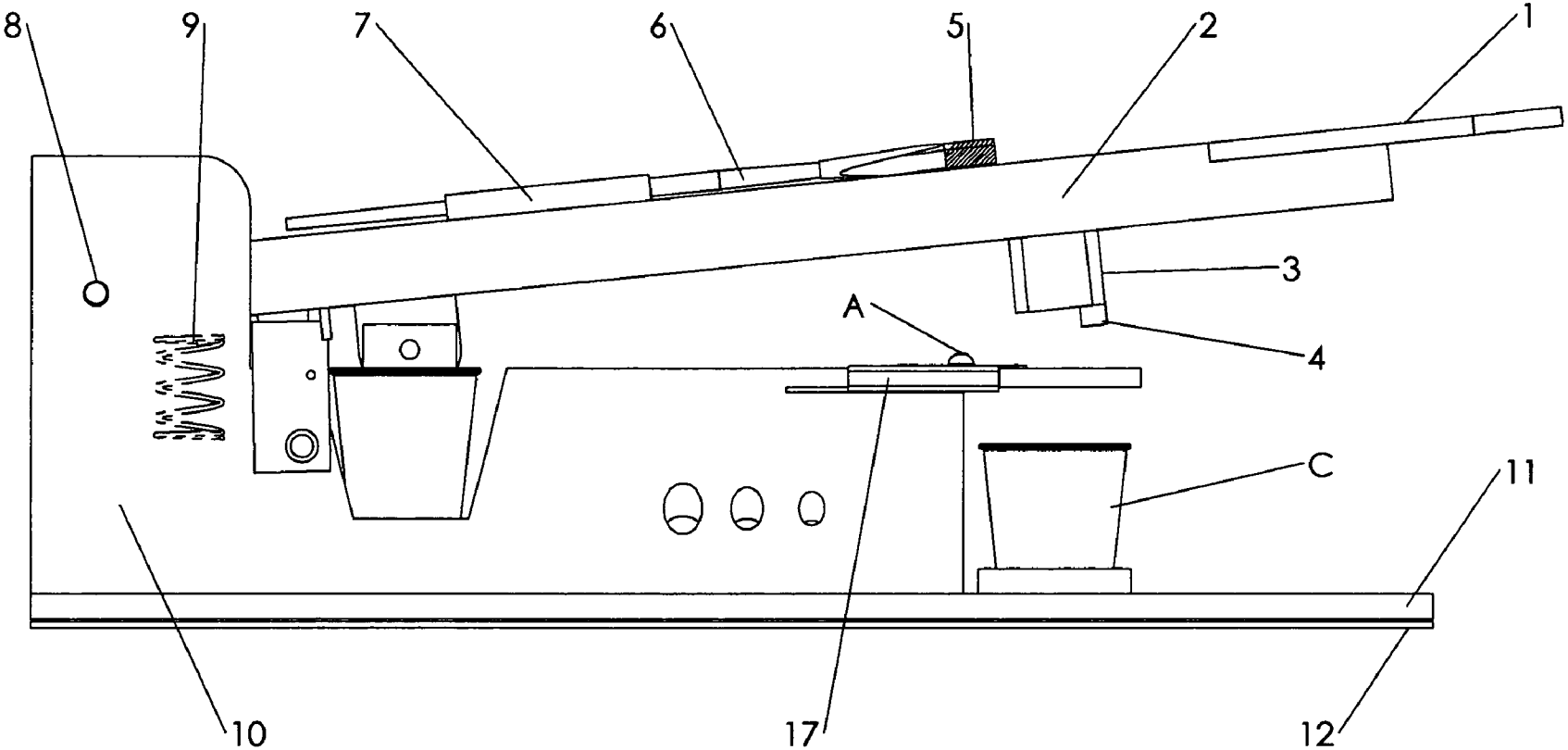
Figure 3:
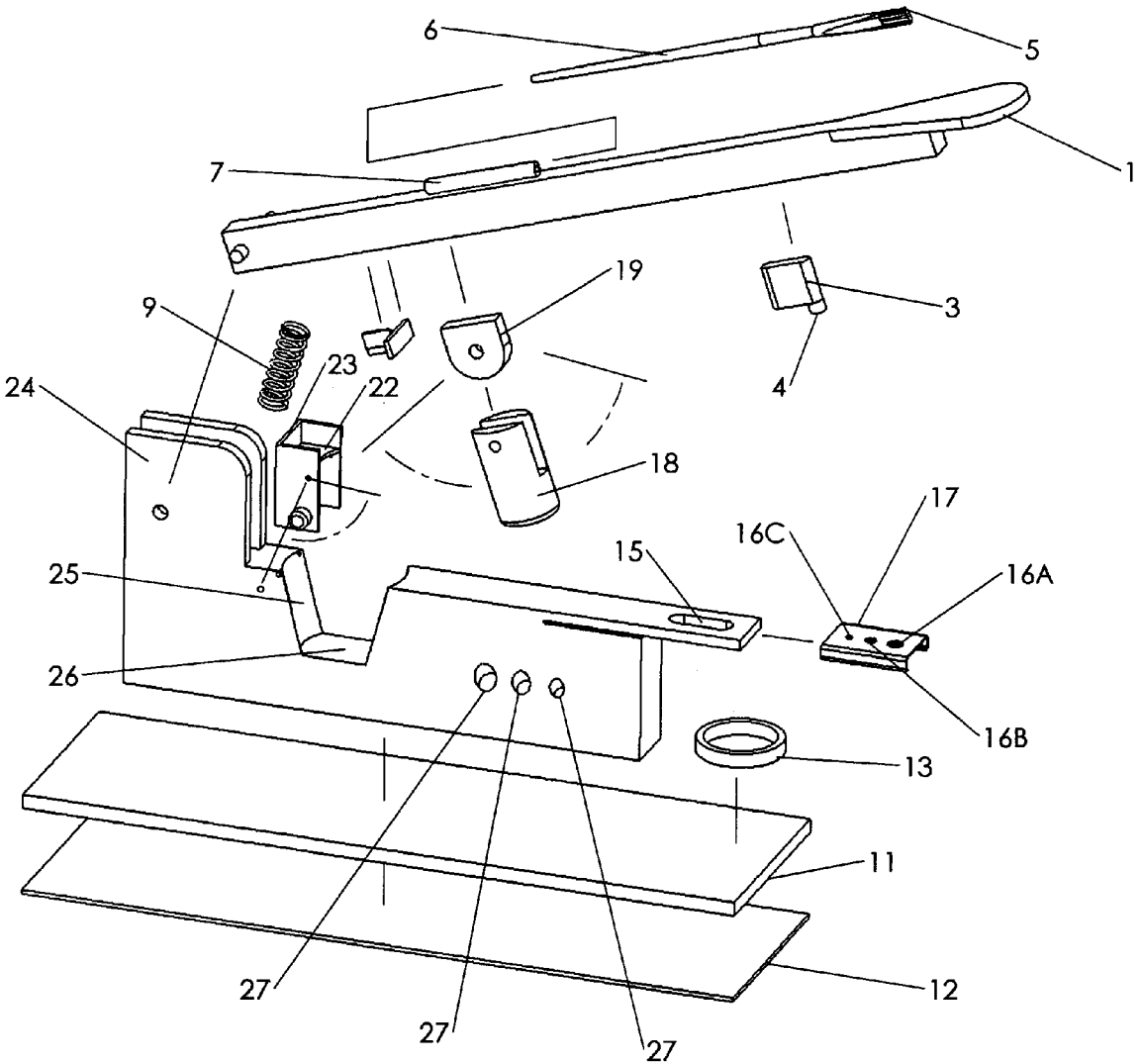
Figure 4:
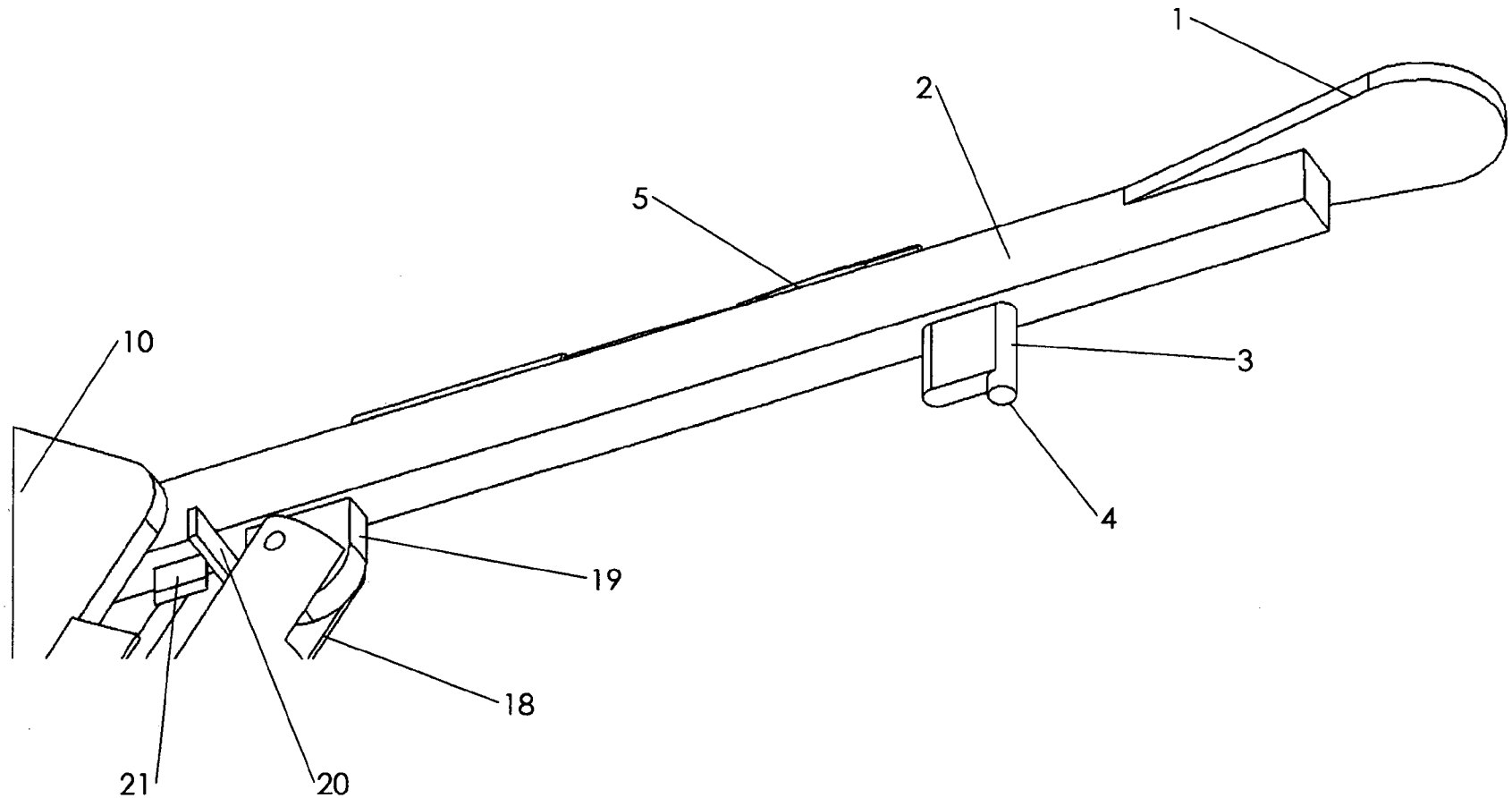
Figure 5:
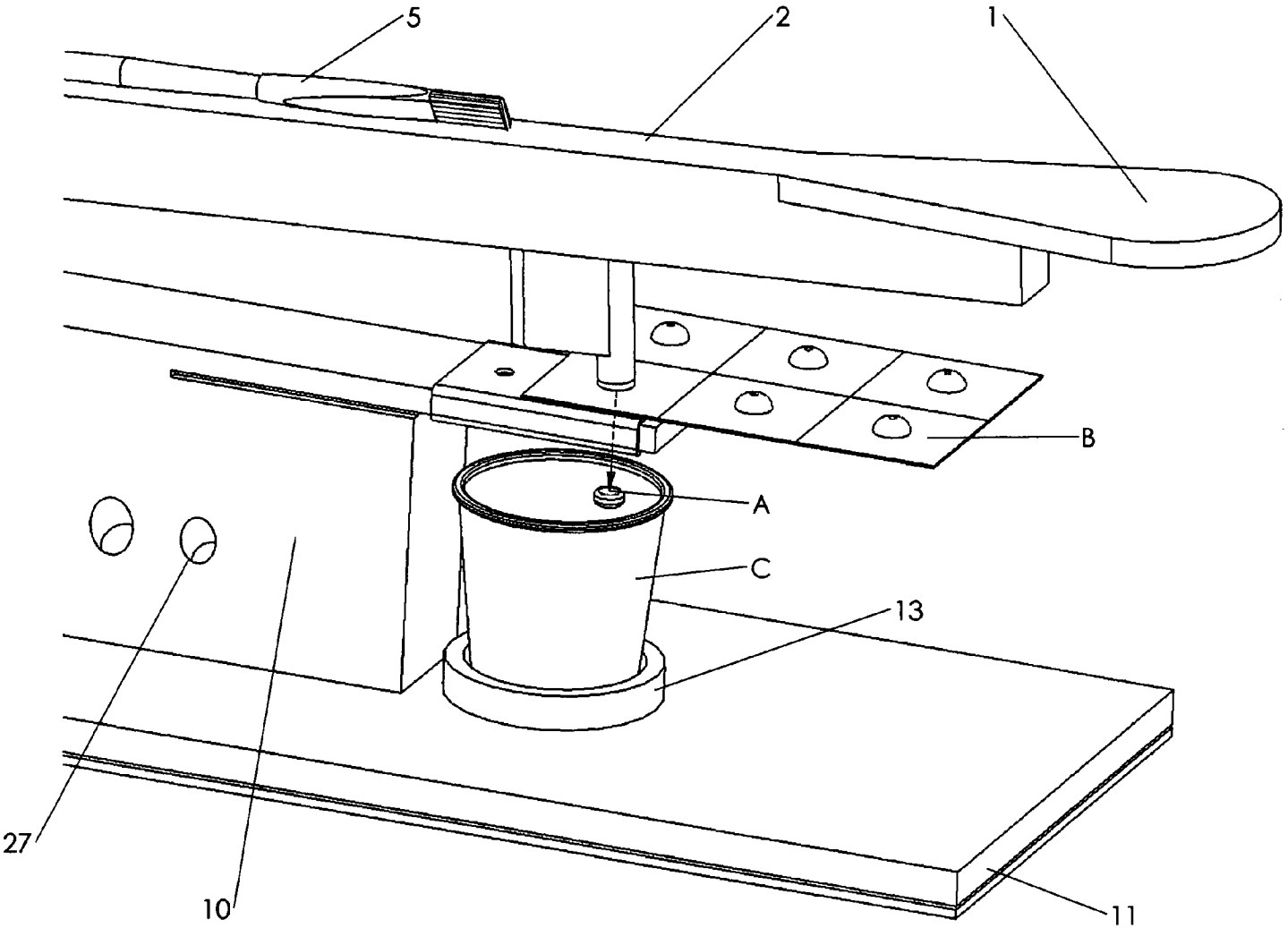
Figure 6:
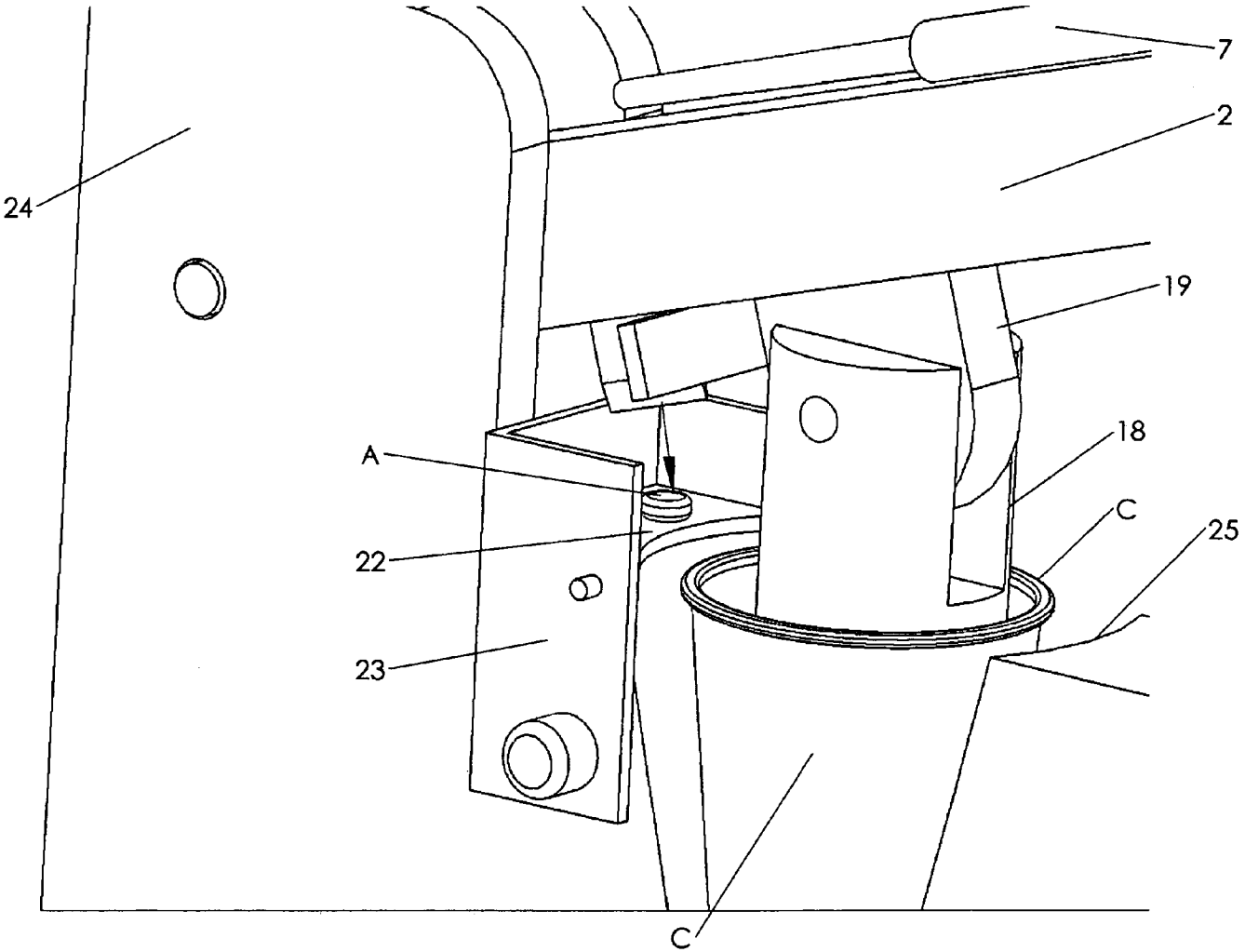

1. FIG. 1 is a perspective view of the instant invention.
2. FIG. 2 is a lateral plan view of the instant invention.
3. FIG. 3 is an exploded view of the instant invention.
4. FIG. 4 is a perspective view of the bottomside of the arm component of the instant invention.
5. FIG. 5 serves to depict the manner in which utilization of the invention facilitates pill extraction.
6. FIG. 6 serves to illustrate the manner in which utilization of the invention facilitates pill splitting.

Figure 7:
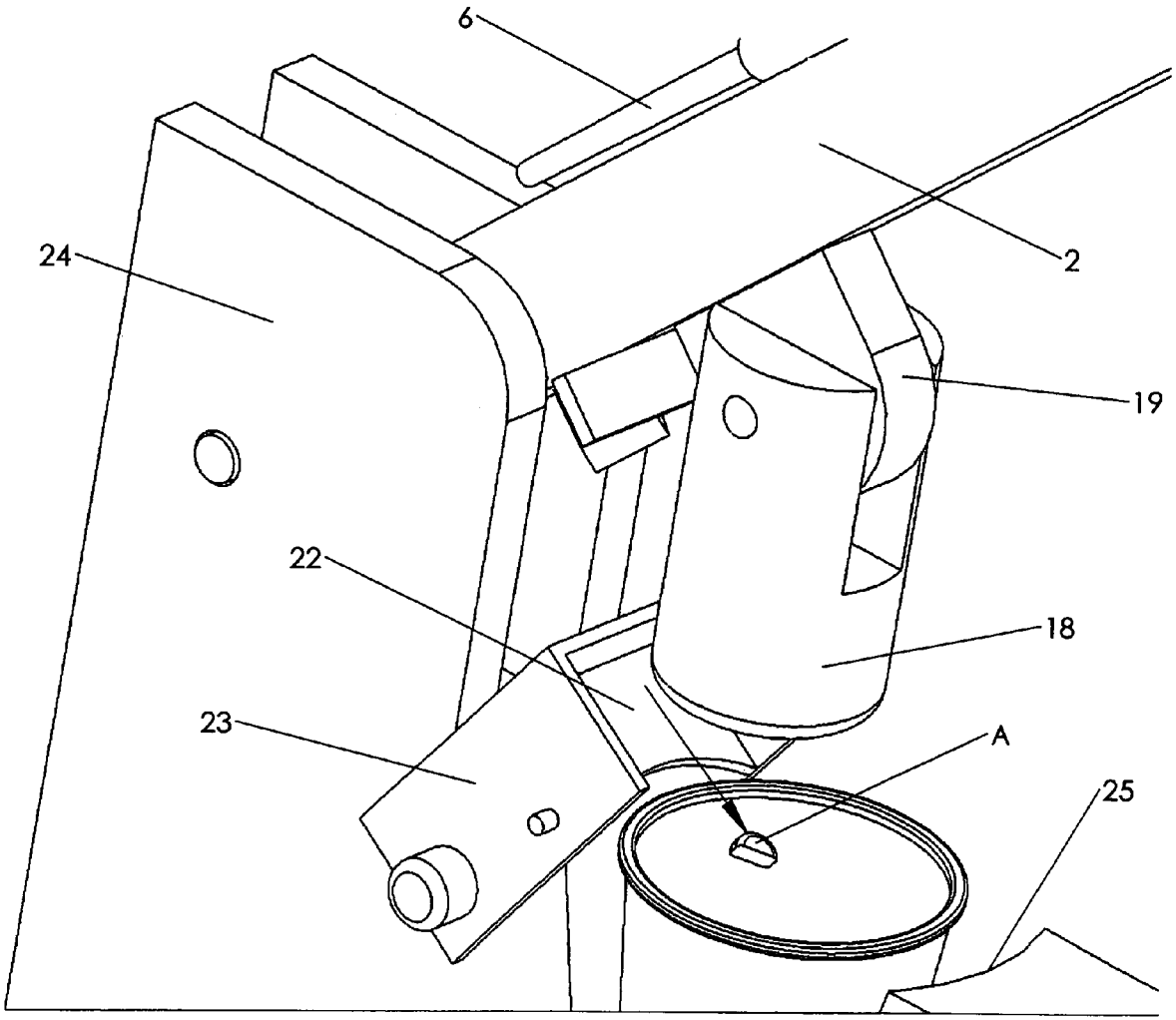

7. FIG. 7 serves to illustrate how a split pill is thereafter amenable to being readily dropped into a pillcup via utilization of the invention.

Figure 8:
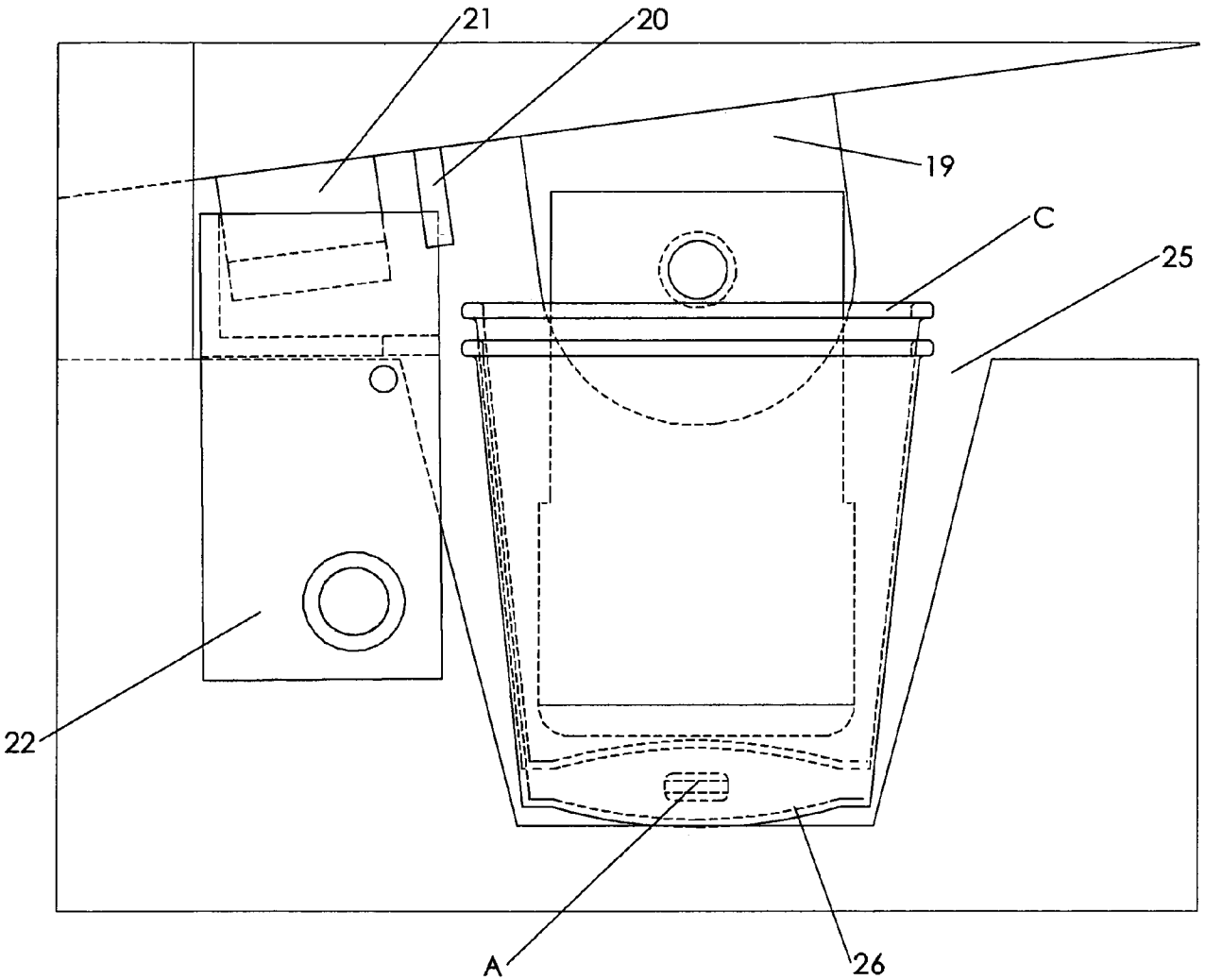

8. FIG. 8 serves to illustrate the manner in which utilization of the invention facilitates pill crushing.

Figure 9:
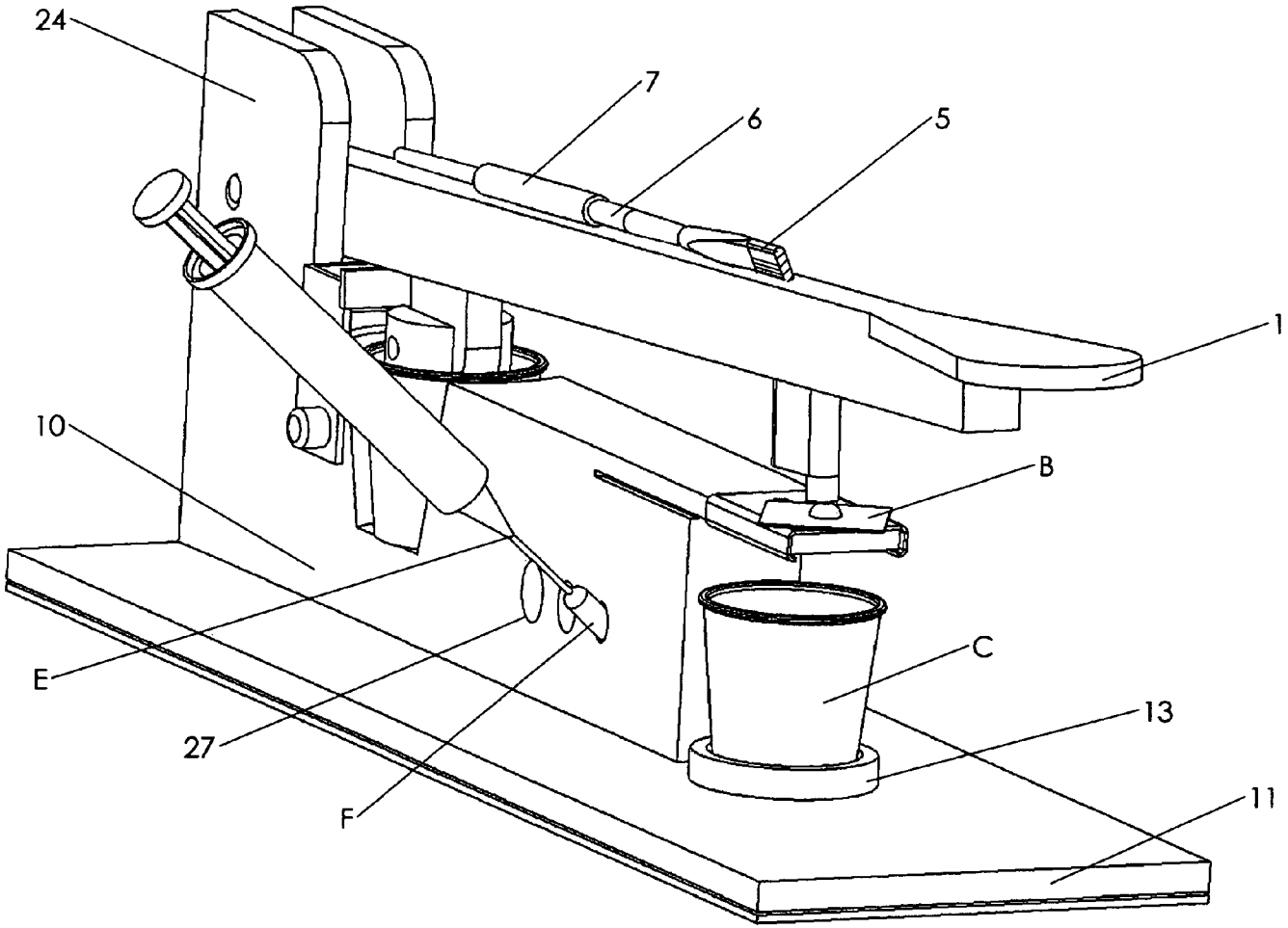

9. FIG. 9 serves to illustrate the manner of extraction of liquid from within a pill jacket first placed within one of the lateral compartments of the invention.

A DESCRIPTION OF THE PREFERRED EMBODIMENTS

FIG. 1 is a perspective view of the intact invention. FIG. 2 is a lateral plan view thereof. FIG. 3 is an exploded view of the invention. Handle 1 shown in FIGS. 1, 2 and 3 is attached to arm component 2 as seen in FIGS. 1 and 2. Handle 1 enables one to push down or pull up on arm component 2 with only a minimal amount of effort. Affixed to the bottom side of arm component 2 as seen in FIGS. 2 and 4 is punchknob component 3. Affixed to the bottomside of punchknob component 2 is punchknob tooth 4. Arm component 2 is pivotably affixed at first pivot point 8 to armstand 10 as seen in FIG. 2. Armstand 10 has a basestand component 11 thereof, which basestand component 11 in turn has anti-skid pad 12 removably affixable thereto as seen in FIGS. 2 and 3. Brush 5 is affixed to fixation component 6 which is held in brush holder 7 affixed atop arm component 2 when the brush 5 is not in use as is also seen in FIG. 2. Reset spring 9 mounted atop armstand 10 as seen in FIG. 2 enables arm component 2 to be readily and smoothly pushed down when efforts are made to extract a pill A from a pill pack B or subsequently split or crush a pill A as can be respectively noted with resort to FIGS. 5, 6, 7 and 8 respectively. The anterior topside of armstand 10 has affixed to it punchplate component 14 within which there is to be found punchplate aperture 15 as seen in FIGS. 2 and 3. Pillsize slider 17 slideably affixed to punchplate component 14 as also seen in FIGS. 2 and 3 has a plurality of through holes 16, 16*a* and 16*b* to there through accommodate extraction of variably sized pills A. Extraction of a pill A from a pill pack B as per FIG. 5 is accomplished by placing pill pack B atop slider 17 over a hole 16 or 16*a* or 16*b* depending upon the size of a pill A to be extracted from typically its plastic covered compartment within pill pack B. Then handle 1 is pushed down thereby pushing arm component 2 down towards the plastic covered compartment holding pill A in pill pack B. Punchknob component 3 or punchknob tooth 4 presses onto the plastic compartment of pill pack B depending on the size of pill A within the plastic compartment of pill pack B (tooth 4 for the smallest of pills A), with the plastic compartment of pill pack B containing a pill A having been first placed over a hole 16 or 16*a* or 16*b* thereby causing the pill A to then be pushed through aperture 15 into a pillcup C then being held below aperture 15 within recessed first pillcup well 13 anteriorly located in the topside of basestand component 11 as shown in FIG. 3 and all as per what is shown in FIG. 5. This extraction feature of the invention serves to permit pill extraction without the need for the extractor to ever touch a pill A with his or her hands. Hygienic considerations are thus greatly accommodated with resort to use of the invention for such purposes. This fact alone will operate to greatly reduce the frequency of nosocomial infections in hospitals and nursing homes. Also, the mechanical advantage in respect of utilization of the invention as contrasted with multiple efforts with the thumb seeking to manually press out a pill A from a pill pack B held above the extractor's index finger is at once obvious. The invention is this respect is a veritable boon to nurses trying to save time in dispensing, especially those with weak or arthritic thumbs. Also, with resort to the invention, pills A are never punched out onto a table and away from a pillcup C then in need, for hygienic reasons, of properly being discarded. It's clear from this vantage point that considerations of economy are also notably at play with respect to extraction with resort to use of the invention. Moreover, it's often necessary to split an extracted pill A. This is accomplished by placing a pillcup C into pillcup wellspace 25 atop floor portion 26 thereof after having first poured pill A from pillcup C onto pill shelf 22 of pivotable pilltray 23 seen in FIGS. 1 and 6. Splitter bar 21 is affixed to the bottomside of arm component 2 as seen in FIG. 4 and perpendicularly to splitterguard component 20 also affixed to the bottomside of arm component 2 as also seen in FIG. 4 Pressing arm component 2 downwardly causes pill A to be split by splitter bar 21 as shown in FIG. 6. One-half of split pill A is then dumped via resort to pivotably turning pilltray 23 pivotably affixed to armstand 10, downwardly, thereby causing the unheld half of pill A to then fall into held pillcup C as shown in FIG. 7 with the other half of pill A being held via brush 5 on pill shelf 22. The remnant half of pill A is then removed from pill shelf 22 with brush 5 by sweeping it into another pillcup C for the benefit of the particular patient then to be administered the split portion of pill A with the remnant half then serving as a subsequent dose for that patient. Pill shelf 22 is then swept clear of debris by way of resort to further use of brush 5 all after having first grabbed fixation component 6 out of brush holder 7. Once again, pill A is never touched by a human hand. Also, splitting is very neat and dependable compared to say conventional splitting on a table top with a knife. Incidents involving nurses cutting themselves while splitting don't occur with resort to use of the invention for such a purpose. Also, brushing post-splitting completely obviates the possibility of cross contamination of medications such as debris from any one earlier split pill A being about the locus where subsequent splitting of a different pill A occurs. Splitterguard component 20 serves to ensure that splitting does not result in split off pill pieces being directed outwardly away from a top edging of a pillcup C. Each of the two pieces of high lateral walling 24 each being respectively a part of lateral siding of armstand 10 as seen in FIG. 2 and to each of which arm component 2 is pivotably attached and exterior to and about where reset spring 9 is attached to the posterior topside of armstand 10, serves to readily facilitate the up or down manipulation of arm component 2. Pill crushing following either pill extraction or pill splitting with resort to utilization of the invention is accomplished as follows. A second pillcup C is placed over a pill A already located within the pillcup C held as noted above within wellspace 25. A heavy pill crusher unit 18 pivotably affixed to pivotstand 19 affixed to the bottom side of arm component 2 as seen in FIG. 4 is then directed straight downwardly as per FIG. 8 into top pillcup C causing the central portion thereof to press down onto the portion pill A then being held within bottom pillcup C. The pivotability feature in respect of affixation of crusher unit 18 to pivotstand 19 serves to ensure total bottomside contact between crusher 18 and the bottom of a top pillcup C. A rigidly held crusher unit 18 would be constrained by the arc created by downward pushing on arm component 2 thereby resulting in poor to no contact with the bottom of a pillcup C thereby making for notably inefficient crushing, at best. The pressure exerted by crusher unit 18 when arm component 2 is so directed downwardly, causes maximally efficient crushing of a pill A between the bottomside of top pillcup C and atop the central portion of bottom pillcup C. There is no debris to be showered about with such crushing. Once again there is no touching of any pill A nor accordingly any possibility of cross-contamination with debris from other pills as would be the case with resort to use of a mortar and pestle device without any post-crushing cleansing thereof. Cleansing followed by a washing of mortar and pestle devices post-crushing is moreover time consuming. A crushed pill A within a pillcup C is, with resort to crushing via use of the invention, then readily deliverable to a patient. Finally, capsular pills F of varying sizes containing liquids in need of extraction therefrom can be placed into one of the lateral compartments 27 of the invention seen in FIG. 2. These compartments 27 of varying sizes are cut at a downward bias into one of the lateral sides of armstand 10 as therein shown, all in the interest of dependably holding such capsular pills F in place. One merely places a given sized capsular pill F containing liquid medicine within a jacket into an appropriately sized compartment 27. Then one inserts a hypodermic needle E into the jacket portion of the so inserted capsular pill F, evacuates the liquid contents therefrom into the needle E, pulls the now empty jacket portion of the capsular pill F out of the compartment 27 which jacket portion would then be being held about the end of needle E all as shown in FIG. 9 and then merely removes the held and now empty jacket from needle E and disposes of it together with the needle portion of needle E after having first dispensed the liquid medicine from the syringe portion of needle E into a pillcup C for the benefit of a patient.

In closing, with an eye towards the tenor and text of the foregoing recitations, it is once again respectfully submitted that the instant invention is not merely new, useful and unique, but rather instead is veritably revolutionary in respect of the art of dispensing medications to person in need of them.

What is claimed is:

1. The multifunctional medicinal dispensary device, comprising:

a. a handle;

b. an arm component;

c. said handle being attached to an anterior portion of said arm component;

d. a punchknob;

e. a punchknob tooth being affixed to a bottomside of said punchknob;

f. said punchknob being affixed to a bottomside of said arm component;

g. an armstand;

h. said arm component being pivotably attached to each of two pieces of oppositely positioned lateral walling with said each being respectively a part of one of two lateral sides of said armstand;

i. a reset spring being mounted to a topside of said armstand and between said two pieces of oppositely positioned lateral walling;

j. a bottomside of said armstand being affixed to a topside of a basestand component;

k. a first pillcup well being positioned in said topside of said basestand component anterior to a front side of said armstand;

l. a punchplate being affixed to an anterior portion of said topside of said armstand;

m. said punchplate having a punchplate aperture within it;

n. a pillsize slider component being slideably affixed over and about said punchplate;

o. said pillsize slider component having a plurality of through holes of differing dimensions within it;

p. a pivotstand being perpendicularly affixed to said bottomside of said arm component posterior to a locus of said punchknob;

q. a pill crusher unit being pivotably affixed to said pivotstand;

r. a splitter bar being affixed to said bottomside of said arm component;

s. a splitterguard component being affixed to said bottomside of said arm component perpendicularly and anteriorly to a locus of said splitter bar and posteriorly to a locus of said pivotstand;

t. a pilltray being pivotably affixed to two lateral sides of said armstand anterior to front edges of said two pieces of oppositely positioned lateral walling;

u. an uppermost vertically positioned side of said pilltray being a pill shelf;

v. a pillcup wellspace amenable to receipt of said pill crusher unit being cut into said armstand anteriorly to the locus of said pivotably affixed pilltray, and;

w. said pillcup wellspace having a floor space for receipt of a pillcup.

2. The multifunctional medicinal dispensary device of claim 1, whereby, a plurality of closed compartments are cut into either one of said two lateral sides of said armstand.

3. The multifunctional medicinal dispensary device of claim 1, whereby, an anti-skid pad is removably affixed to a bottomside of said basestand component.

4. The multifunctional medicinal dispensary device, comprising:

a. a handle;

b. an arm component;

c. said handle being attached to an anterior portion of said arm component;

d. a punchknob;

e. a punchknob tooth being affixed to a bottomside of said punchknob;

f. said punchknob being affixed to a bottomside of said arm component;

g. an armstand;

h. said arm component being pivotably attached to each of two pieces of oppositely positioned lateral walling with said each being respectively a part of one of two lateral sides of said armstand;

i. a reset spring being mounted to a topside of said armstand and between said two pieces of oppositely positioned lateral walling;

j. a bottomside of said armstand being affixed to a topside of a basestand component;

k. a first pillcup well being positioned in said topside of said basestand component anterior to a front side of said armstand;

l. a punchplate being affixed to an anterior portion of said topside of said armstand;

m. said punchplate having a punchplate aperture within it;

n. a pillsize slider component being slideably affixed over and about said punchplate;

o. said pillsize slider component having a plurality of through holes of differing dimensions within it;

p. a pivotstand being perpendicularly affixed to said bottomside of said arm component posterior to a locus of said punchknob;

q. a pill crusher unit being pivotably affixed to said pivotstand;

r. a splitter bar being affixed to said bottomside of said arm component;

s. a splitterguard component being affixed to said bottomside of said arm component perpendicularly and anteriorly to a locus of said splitter bar and posteriorly to a locus of said pivotstand;

t. a pilltray being pivotably affixed to two lateral sides of said armstand anterior to front edges of said two pieces of oppositely positioned lateral walling;

u. an uppermost vertically positioned side of said pilltray being a pill shelf;

v. a brush;

w. said brush being affixed to a fixation component;

x. a brush holder holding said fixation component and said brush, and;

y. said brush holder being positioned on a topside of said arm component.

5. The multifunctional medicinal dispensary device of claim 4, whereby, a plurality of closed compartments are cut into either one of said two lateral sides of said armstand.

6. The multifunctional medicinal dispensary device of claim 4, whereby, an anti-skid pad is removably affixed to a bottomside of said basestand component.

* * * * *